US007062420B2

(12) United States Patent
Poe, Jr.

(10) Patent No.: US 7,062,420 B2
(45) **Date of Patent: *Jun. 13, 2006**

(54) PRODUCTION OPTIMIZATION METHODOLOGY FOR MULTILAYER COMMINGLED RESERVOIRS USING COMMINGLED RESERVOIR PRODUCTION PERFORMANCE DATA AND PRODUCTION LOGGING INFORMATION

(75) Inventor: Bobby D. Poe, Jr., Houston, TX (US)

(73) Assignee: Schlumberger Technology Corp., Sugar Land, TX (US)

( * ) Notice: Subject to any disclaimer, the term of this patent is extended or adjusted under 35 U.S.C. 154(b) by 1013 days.

This patent is subject to a terminal disclaimer.

(21) Appl. No.: 09/967,181

(22) Filed: Sep. 28, 2001

(65) Prior Publication Data

US 2002/0096324 A1 Jul. 25, 2002

Related U.S. Application Data

(60) Provisional application No. 60/237,957, filed on Oct. 4, 2000.

(51) Int. Cl.
*G06G 7/48* (2006.01)

(52) U.S. Cl. ..... 703/10; 703/2; 702/13; 166/250.07

(58) Field of Classification Search ..... 703/2, 703/10; 702/6, 11, 12, 13; 166/250.07, 166/369; 73/152.14, 152.31; 250/256
See application file for complete search history.

(56) References Cited

U.S. PATENT DOCUMENTS 4,742,459 A * 5/1988 Lasseter ..... 702/12
4,803,873 A * 2/1989 Ehlig-Economides .... 73/152.31
5,305,209 A 4/1994 Stein et al. ..... 702/13
5,675,147 A * 10/1997 Ekstrom et al. ..... 250/256
5,960,369 A * 9/1999 Samaroo ..... 702/6
6,101,447 A * 8/2000 Poe, Jr. ..... 702/13
6,571,619 B1 * 6/2003 Herron et al. ..... 73/152.14
2002/0043370 A1 * 4/2002 Poe, Jr. ..... 703/2

FOREIGN PATENT DOCUMENTS

EP 0 217 684 4/1987
EP 0 481 866 4/1992

OTHER PUBLICATIONS

Qahtani, A. A New Technique and Field Application for Determining Reservoir Characteristics From Well Performance Data, SPE Paper 68141 presented at the SPE Middle East Oil Show & Conference held in Bahrain, Mar. 2001, pp. 1-9.*

(Continued)

*Primary Examiner*—Russell Frejd
(74) *Attorney, Agent, or Firm*—Rodney Warfford; Tim Curington; Robin Nava

(57) ABSTRACT

An overall petroleum reservoir production optimization methodology permits the identification and remediation of unstimulated, under-stimulated, or simply poorly performing reservoir completed intervals in a multilayer commingled reservoir that can be recompleted using any of various recompletion methods (including but not limited to hydraulic fracturing, acidization, re-perforation, or drilling of one or more lateral drain holes) to improve the productivity of the well. This provides an excellent reservoir management tool and includes the overall analysis and remediation methodology that has been developed for commingled reservoirs. The specialized recompletion techniques can be used to improve the productivity of previously completed individual reservoir intervals in a commingled reservoir.

15 Claims, 1 Drawing Sheet

Individual Reservoir Interval Flow Rates and Wellbore Pressure Traverses

OTHER PUBLICATIONS

Poe, B.D. Evaluation of Reservoir and Hydraulic Fracture Properties in Geopressure Reservoirs, SPE Paper 64732 presented at the SPE International Oil and Gas Conference and Exhibition held in Beijing, China, Nov. 2000, pp. 1-13.*

Sarnaniego et al., F. On the Determination of the Pressure-Dependent Characteristics of a Reservoir Through Transient Pressure Testing, SPE Paper 19774, 64th Annual Technical Conference of the Society of Petroleum Engineers, Oct. 1999, pp. 1-12.*

Osman, M.E. Pressure Analysis of a Fractured Well in Multilayered Reservoirs, Journal of Petroleum Science and Engineering, vol. 9, Iss. 1, Feb. 1993, pp. 49-66.*

SPE 10017 "Optimizing the Development Plan", Rowan, Mar. 1982.

SPE 52178 "Production Data Analysis and Forecasting Using a Comprehensive Analysis System", Poe, Mar. 1999.

SPE 38851 "Integrated reservoir Management Via Full Field Modeling, Pt. McIntyre Field, Alaska", Hagedoorn, Oct. 1997.

SPE 18321 "Putting Geology Into Reservoir Simulations: A Three-Dimensional Modeling Approach", Johnson, Oct. 1988.

SPE 65108 "Simulation of a Tight Gas Reservoir with Horizontal Multifractured Wells", Ehrl et al., Oct. 2000.

Schlumberger XP002194463 "Advanced Interpretation of Wireline Logs" 1986.

* cited by examiner

Individual Reservoir Interval Flow Rates and Wellbore Pressure Traverses

10

PRODUCTION OPTIMIZATION METHODOLOGY FOR MULTILAYER COMMINGLED RESERVOIRS USING COMMINGLED RESERVOIR PRODUCTION PERFORMANCE DATA AND PRODUCTION LOGGING INFORMATION

CROSS REFERENCE TO RELATED PROVISIONAL APPLICATION

This application is based on Provisional Application Ser. No. 60/237,957 filed on Oct. 4, 2000.

BACKGROUND OF THE INVENTION

1. Field of the Invention

The invention is generally related to methods and processes for analyzing well production data and for optimizing production of multilayer commingled reservoirs and is specifically directed to a methodology for optimizing production using commingled performance data and logging information.

2. Discussion of the Prior Art

Field production performance data and multiple pressure transient tests over a period of time for oil and gas wells in geopressured reservoirs have been found to often exhibit marked changes in reservoir effective permeability over the producing life of the wells. Similarly, the use of quantitative fractured well diagnostics to evaluate the production performance of the hydraulically fractured wells have clearly shown that effective fracture half-length and conductivity can be dramatically reduced over the producing life of the wells. A thorough investigation of this topic may be found in the paper presented by Bobby D. Poe, the inventor of the subject application, entitled: "Evaluation of Reservoir and Hydraulic Fracture Properties in Geopressure Reservoir," Society of Petroleum Engineers, SPE 64732.

Some of the earliest references to the fact that subterranean reservoirs do not always behave as rigid and non-deformable bodies of porous media may be found in the groundwater literature, see for example, "Compressibility and Elasticity of Artesian Aquifers," by O. E. Meinzer, Econ. Geol. (1928) 23, 263–271. and "Engineering Hydraulics," by C. E. Jacob, John Wiley and Sons, Inc. New York (1950) 321–386.

The observations of early experimental and numerical studies of the effects of stress-dependent reservoir properties demonstrated that low permeability formations exhibit a proportionally greater reduction in permeability than high permeability formations. The stress-dependence of reservoir permeability and fracture conductivity over the practical producing life of low permeability geopressured reservoirs has resulted in the following observations:

1. Field evidence of reservoir effective permeability degradation with even short production time can often be observed in geopressured reservoirs.

2. Quantitative evaluation of the field production performance of hydraulic fractures in both normal and geopressured reservoirs have resulted in the observation that the fracture conductivity of hydraulically fractured wells commonly decreases with production time.

3. Multiphase fracture flow has been demonstrated to dramatically reduce the effective conductivity of fractures.

4. Pre-fracture estimates of formation effective permeability derived from pressure transient test or production analyses are often not representative of the reservoir effective permeability exhibited in the post-fracture production performance.

The analysis of production data of wells to determine productivity has been used for almost fifty years in an effort to determine in advance what the response of a well will be to production-simulation treatment. A discourse on early techniques may be found in the paper presented by R. E. Gladfelter, entitled "Selecting Wells Which Will Respond to Production-Simulation Treatment," Drilling and Production Procedures, API (American Petroleum Institute), Dallas, Tex., 117–129 (1955). The pressure-transient solution of the diffusivity equation describing oil and gas flow in the reservoir is commonly used, in which the flow rate normalized pressure drops are given by:

$$(P_i - P_{wf})/q_o, \text{ and}$$

$$\{P_p(P_i) - P_p(P_{wf})\}/q_g,$$

for oil and gas reservoir analyses, respectively, wherein:

$P_i$ is the initial reservoir pressure (psia), $P_{wf}$ is the sandface flowing pressure (psia)

$q_o$ is the oil flow rate, STB/D $P_p$ is the pseudopressure function, psia$^2$/cp, and $q_g$ is the gas flow rate, Mscf/D While analysis of production data using flow rate normalized pressures and the pressure transient solutions worked reasonably well during the infinite-acting radial flow regime of unfractured wells, boundary flow results have indicated that the production normalization follows an exponential trend rather than the logarithmic unit slope exhibited during the pseudosteady state flow regime of the pressure-transient solution.

Throughout most all production history of a well, a terminal pressure is imposed on the operating system, whether it is the separator operating pressure, sales line pressure, or even atmospheric pressure at the stock tank. In any of these cases, the inner boundary condition is a Dirichlet condition (specified terminal pressure). Whether the terminal pressure inner boundary condition is specified at some point in the surface facilities or at the sandface, the inner boundary condition is Dirichlet and the rate-transient solutions are typically used. It is also well known that at late production times the inner boundary condition at the bottom of the well bore is generally more closely approximated with a constant bottomhole flowing pressure rather than a constant rate inner boundary condition.

An additional problem that arises in the use of pressure-transient solutions as the basis for the analysis of production data is the quantity of noise inherent in the data. The use of pressure derivative functions to reduce the uniqueness problems associated with production data analysis of fractured wells during the early fracture transient behavior even further magnifies the effects of noise in the data, commonly requiring smoothing of the derivatives necessary at the least or making the data uninterpretable at the worst.

There have been numerous attempts to develop more meaningful data in an effort to maximize the production level of fractured wells. One such example is shown and described in U.S. Pat. No. 5,960,369 issued to B. H. Samaroo, describing a production profile predictor method for a well having more than one completion wherein the process is applied to each completion provided that the well can produce from any of a plurality of zones or in the event of multiple zone production, the production is commingled.

From the foregoing, it can be determined that production of fractured wells could be enhanced if production performance could be properly utilized to determine fracture efficiency. However, to date no reliable method for generating meaningful data has been devised. The examples of the prior art are at best speculative and have produced unpredictable and inaccurate results.

SUMMARY OF THE INVENTION

The subject invention is an overall petroleum reservoir production optimization methodology that permits the identification and remediation of unstimulated, under-stimulated, or simply poorly performing reservoir completed intervals in a multilayer commingled reservoir that can be recompleted using any of various recompletion methods (including but not limited to hydraulic fracturing, acidization, re-perforation, or drilling of one or more lateral drain holes) to improve the productivity of the well. This invention is an excellent reservoir management tool and includes the overall analysis and remediation methodology that has been developed for commingled reservoirs. This invention utilizes the recently developed commingled reservoir system production allocation analysis model and procedures described in my copending application, entitled: "Evaluation of Reservoir and Hydraulic Fracture Properties in Multilayer Commingled Reservoirs Using Commingled Reservoir Production Data and Production Logging Information," Ser. No. 09/952,656, filed on Sep. 12, 2001, incorporated by reference herein.

The specialized recompletion techniques that can be used to improve the productivity of previously completed individual reservoir intervals in a commingled reservoir include but are not limited to coil tubing hydraulic fracturing, conventional fracture and matrix acidizing stimulation techniques that use zonal isolation, and re-perforation of the individual completed intervals.

The subject invention is a method of and process for evaluating reservoir intrinsic properties, such as reservoir effective permeability, radial flow steady-state skin effect, reservoir drainage area, and dual porosity reservoir parameters omega (dimensionless fissure to total system storativity) and lambda (matrix to fissure crossflow parameter) of the individual unfractured reservoir layers in a multilayer commingled reservoir system using commingled reservoir production data, such as wellhead flowing pressures, temperatures and flow rates and/or cumulatives of the oil, gas, and water phases, and production log information (or pressure gauge and spinner survey measurements). The method and process of the invention also permits the evaluation of the hydraulic fracture properties of the fractured reservoir layers in the commingled multilayer system, i.e., the effective fracture half-length, effective fracture permeability, permeability anisotropy, reservoir drainage area, and the dual porosity reservoir parameters omega and lambda. The effects of multiphase and non-Darcy fracture flow are also considered in the analysis of fractured reservoir layers.

The production performance of horizontal and slanted well completions, including both unfractured and hydraulically fractured horizontal and slanted wellbores, can be evaluated using the subject invention to also determine the vertical-horizontal permeability anisotropy ratio, and effective horizontal wellbore length. Radial composite reservoir models can also be used in the analysis procedure to identify the individual completed interval properties of a commingled multilayer reservoir with two or more regions of distinctly different properties.

The flow rates and cumulative production of all three fluids (oil or condensate, gas and water) produced from each completed reservoir interval and the corresponding midzone wellbore pressure history are obtained using the commingled reservoir production allocation analysis model and procedures presented in my aforementioned copending application, in addition to the commingled reservoir production history record, and production log (or spinner survey and pressure gauge) measurements of the well. The identification of water and hydrocarbons can be determined from the production log. If the more advanced gas holdup detection and measurement is used in combination with the production log, the gas and hydrocarbon liquid production can also be determined from the flowing wellstream fluid.

DETAILED DESCRIPTION OF THE PREFERRED EMBODIMENTS

Figure 1:
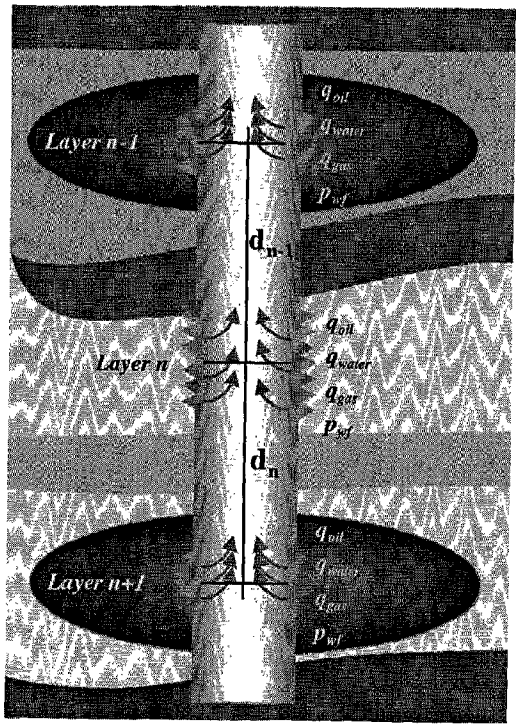
FIG. 1 is an illustration of the systematic and sequential computational procedure in accordance with the subject invention.

The subject invention is directed to a method for optimizing overall petroleum reservoir production through the identification and remediation of unstimulated, under-stimulated, or simply poorly performing reservoir completed intervals in a multilayer commingled reservoir, permitting recompletion using any of various recompletion methods (including but not limited to hydraulic fracturing, acidization, re-perforation, or drilling of one or more lateral drain holes). The method of the subject invention provides a reservoir management tool and includes the overall analysis and remediation methodology that has been developed for commingled reservoirs. This invention utilizes the recently developed commingled reservoir system production allocation analysis model and procedures described in my copending application, entitled: "Evaluation of Reservoir and Hydraulic Fracture Properties in Multilayer Commingled Reservoirs Using Commingled Reservoir Production Data and Production Logging Information," Ser. No. 09/952,656 filed on Sep. 12, 2001, incorporated by reference herein.

FIG. 1 is an illustration of the systematic and sequential computational procedure in accordance with the subject invention. Beginning at the wellhead (10), the pressure traverses to the midpoint of each completed interval are computed in a sequential manner. The fluid flow rates in each successively deeper segment of the wellbore are decreased from the previous wellbore segment by the production from the completed intervals above that segment of the wellbore. The mathematical relationships that describe the fluid phase flow rates (into or out) of each of the completed intervals in the wellbore are given as follows for oil, gas, and water production of the $j^{th}$ completed interval, respectively:

$$q_{oj}(t)=q_{ot}(t)f_{oj}(t),$$

$$q_{gj}(t)=q_{gt}(t)f_{gj}(t),$$

$$q_{wj}(t)=q_{wt}(t)f_{wj}(t),$$

where:

$q_{oj}$ is the $j^{th}$ completed interval segment hydrocarbon liquid flow rate, STB/D, $q_{ot}$ is the composite system flow rate, STB/D, $f_{oj}$ is the $j^{th}$ completed interval hydrocarbon liquid flow rate fraction of total well hydrocarbon liquid flow rate, fraction, $q_{gj}$ is the $j_t$ interval gas flow rate, Mscf/D j is the index of completed intervals, $q_{gt}$ is the composite system total well gas flow rate, Mscf/D, $f_{gj}$ is the completed interval gas flow rate fraction of total well gas flow rate, fraction, $q_{wj}$ is the $j^{th}$ interval water flow rate, STB/D $q_{wt}$ is the composite system total well water flow rate, STB/D $f_{wj}$ is the $j^{th}$ completed interval water flow rate fraction of total well water flow rate, fraction.

Once the corresponding fluid flow rates in each segment of the wellbore are defined mathematically, using the computational procedure of my aforementioned copending application, this data is combined with the commingled reservoir production history record, and production log (or spinner survey and pressure gauge) measurements of the well to determine the most effective recompletion strategy. If more advanced gas holdup detection and measurement systems are used in combination with the production log, the gas and hydrocarbon liquid production can also be determined from the flowing wellstream fluid.

Multiple production logs are considered to properly describe the production histories of the individual completed intervals in a multilayer commingled reservoir system. The crossflow between the commingled system reservoir layers in the wellbore may also be specified, using the calculation in accordance with the aforementioned application. All measured production log information can be used in the analysis, including the measured wellbore pressures, temperatures and fluid densities. The pressure measurements in the wellbore permit selection of the best-match wellbore pressure traverse correlation to use in each wellbore segment. The wellbore temperature and fluid density distributions in the wellbore can also be directly used in the pressure traverse calculation procedures.

The corresponding fluid phase flow rates in each segment of the wellbore are also defined mathematically with the relationships as follows for oil, gas and water for the $n^{th}$ wellbore pressure traverse segment, respectively.

$$q_{on}(t) = q_{ot}(t) - \sum_{\substack{j=1 \\ n>1}}^{n-1} q_{oj}(t)$$

$$q_{gn}(t) = q_{gt}(t) - \sum_{\substack{j=1 \\ n>1}}^{n-1} q_{gj}(t)$$

$$q_{wn}(t) = q_{wt}(t) - \sum_{\substack{j=1 \\ n>1}}^{n-1} q_{wj}(t)$$

The flow rate and pressure traverse computations are performed in a sequential manner for each wellbore segment, starting at the surface or wellhead (10) and ending with the deepest completed interval in the wellbore, for both production and injection scenarios.

The fundamental inflow relationships that govern the transient performance of a commingled multi-layered reservoir are fully honored in the analysis provided by the method of the subject invention. Assuming that accurate production logs are run in a well, when a spinner passes a completed interval without a decrease in wellbore flow rate (comparing wellbore flow rates at the top and bottom of the completed interval, higher or equal flow rate at the top than at the bottom), no fluid is entering the interval from the wellbore (no loss to the completed interval, i.e., no crossflow). Secondly, once the minimum threshold wellbore fluid flow rate is achieved to obtain stable and accurate spinner operation, all higher flow rate measurements are also accurate. Lastly, the sum of all of the completed interval contributions equals the commingled the system production flow rates for both production and injection.

In the preferred embodiment of the invention, two ASCII input data files are used for the analysis. One file is the analysis control file that contains the variable values for defining how the analysis is to be performed (which fluid property and pressure traverse correlations are use, and the wellbore geometry and production log information). The other file contains commingled system wellhead flowing pressures and temperatures, and either the individual fluid phase flow rates or cumulative production values as a function of production time.

Upon execution of the analysis two output files are generated. The general output file contains all of the input data specified for the analysis, the intermediate computational results, and the individual completed interval and defined reservoir unit production histories. The dump file contains only the tabular output results for the defined reservoir units that are ready to be imported elsewhere.

The analysis control file contains a large number of analysis control parameters that the user can use to tailor the production allocation analysis to match most commonly encountered wellbore and reservoir conditions.

The composite production log history and the commingled reservoir system well production rates or cumulatives are used to compute the individual completed interval production rates or cumulatives. The individual fluid phase flow rates can then be determined from the specified individual fluid phase cumulative production or vice versa, for both the commingled reservoir system wellhead production values and also for the individual completed interval values. Either the commingled reservoir system well production flow rates or cumulative production values may be specified as additional input.

Using the fluid flow rates in each wellbore section, the pressure traverse in each wellbore segment is evaluated, specifically the wellbore pressure at the top of that wellbore section, and the temperature and fluid density distributions in that section of the wellbore traverse. This analysis is performed sequentially starting at the surface and continuing to the deepest completed interval of the well. The fluid flow phase flow rates in each wellbore traverse segment are the differences between the commingled system total well fluid flow rates and the sum of the flow rates of the individual fluid phases from all of the completed intervals above that wellbore traverse segment in the well. Therefore the flow rates used in the pressure traverse calculations of the topmost traverse segment in the well are the total system well flow rates. For the second completed interval, the fluid flow rates used in the pressure traverse evaluation are the total system well flow rates minus the flow rates of each of the fluid phases in the top completed interval. The wellbore pressures at the top of the second pressure traverse are therefore equal to the wellbore pressures at the bottom of the first pressure traverse. This process is repeated sequentially for all of the deeper completed intervals in the wellbore.

From this analysis, a complete production history is computed for each individual completed reservoir interval. The complete production history data set includes the midzone wellbore pressures and the hydrocarbon liquid (oil or condensate), gas, and water flow rates and cumulative production values as a function of production time. This also permits the evaluation of user defined reservoir units that consist of one or more completed intervals. The reservoir units can be either fracture treatment stages, or simply completed intervals that are located close in proximity together, or simply the users specification of composite reservoir unit production histories. These individual completed interval production histories or the composite reservoir unit production histories are then evaluated using one or more of several single zone production performance analyses.

Perforation and gravel pack completion pressure loss models may be included to directly compute the sandface flowing and shut-in pressures from the wellbore and shut-in wellbore pressures for each individual completed interval. Several perforation completion loss models are available in the analyses, as well as numerous gravel pack completion loss models.

The quantitative analysis models used herein invert the individual completed interval or defined reservoir unit production histories to determine the in situ fracture and reservoir properties in a multilayer commingled reservoir system. The results can then be used to identify the unstimulated, under-stimulated or simply poorly performing completed intervals in the wellbore that can be stimulated to improved productivity. Examples include, but are not limited to, various forms of fracturing, acidization, or re-perforation. Fracturing operations to recomplete the isolated completed intervals requiring production improvement can be conducted using conventional fracture stimulation methodology with zonal isolation techniques. Examples include, but are not limited to, sand plugs, bridge plugs, packers, and squeeze techniques, or with the more recently introduced hydraulic fracturing with coil tubing. Similarly, acid stimulation of the poorly stimulated completed intervals can be performed using conventional acid stimulation methodology and equipment or with coil tubing, with zonal isolation when required. Re-perforation of poorly completed intervals can also be accomplished by various means including but not limited to wireline and coil tubing conveyed perforation methods.

Economic evaluation of the production enhancement achieved due to the recompletion of the underperforming completed intervals of the well can then be performed to determine the viability of various possible and practical recompletion techniques.

The invention includes the overall reservoir and production optimization methodology described in my aforementioned application and utilizes every possible piece of reservoir, completion, and production performance information available for the well. This includes but is not limited to: open and cased hole well log information; wellbore tubular goods and configuration; wellbore deviation hole surveys; perforating and gravel pack completion information; well stimulation techniques, treatment execution, and evaluation; production log, spinner survey, and wellbore measurements; surface separation equipment and operating conditions; pressure or rate-transient test data; composite system commingled reservoir production data; geologic, geophysical, and petrophysical information and techniques for describing the reservoir; periodic reservoir pressure and deliverability tests; and the overall well drilling, completion, and production history. The method is extremely flexible and permits consideration of all of the existing well drilling, completion and production information that is available, as well as any additional data that is newly acquired.

The invention claimed is:

1. A computer implemented method for providing production optimization of reservoir completions having a plurality of completed intervals via available production analysis and production logging data which provides a quantitative analysis procedure for reservoir and fracture properties using commingled reservoirs, comprising the steps of:

a. measuring pressures for specific zones in a reservoir;

b. selecting a traverse model;

c. computing midzone pressures using the traverse model;

d. comparing the computed midzone pressures with the measured pressures;

e. modeling the bottomhole pressure of the reservoir based on the traverse model;

f. comparing the computed pressures with historic data; and g. determining and selecting a recompletion process for maximizing zone-by-zone production.

2. The method of claim 1, including the step of performing an economic evaluation to determine the value of the selected recompletion process.

3. The method of claim 1, wherein the comparison step includes accepting the comparison if the computed midzone pressures are within a predefined tolerance of the measured pressures and rejecting the comparison if the computed midzone pressures are outside of the predefined tolerance.

4. The method of claim 3, wherein upon rejection the selecting step and the computing step and the comparing step are repeated until acceptance is achieved.

5. The method of claim 1, wherein the reservoir is separated into defined intervals from top to bottom, each having a top point, midpoint and a bottom point, and wherein the wellbore pressure traverse is computed using the total reservoir commingled production flow rates to the midpoint of the top completed interval.

6. The method of claim 5, wherein the fluid flow rates of the wellbore between the midpoint of the top and middle completed intervals are computed using the total fluid phase flow rates of the commingled reservoir minus the flow rates from the top completed interval.

7. The method of claim 6, wherein the pressure traverse in the wellbore between the midpoints of the middle and lower completed intervals is computed using the fluid phase flow rates that are the difference between the commingled reservoir system total fluid phase flow rates and the sum of the phase flow rates from the top and middle completed intervals.

8. The method of claim 1, wherein the flow rate and pressure traverse computation in the computation step are performed in a sequential manner for each interval, starting at the wellhead and proceeding to the deepest completed interval.

9. A computer implemented method for providing production optimization of reservoir completions having a plurality of completed intervals via available production analysis and production lagging data which provides a quantitative analysis procedure for reservoir and fracture properties using commingled reservoirs, comprising the steps of:

a. measuring pressures for specific zones in a reservoir;

b. selecting a traverse model;

c. computing midzone pressures using the traverse model;

d. comparing the computed midzone pressures with the measured pressures;

e. modeling the bottomhole pressure of the reservoir based on the traverse model;

f. comparing the computed pressures with historic data;

g. determining and selecting a recompletion process for maximizing zone-by-zone production; and h. performing an economic evaluation to determine the value of the selected recompletion process.

10. The method of claim 9, wherein the comparison step includes accepting the comparison if the computed midzone pressures are within a predefined tolerance of the measured pressures and rejecting the comparison if the computed midzone pressures are outside of the predefined tolerance.

11. The method of claim 10, wherein upon rejection the selecting step and the computing step and the comparing step are repeated until acceptance is achieved.

12. A computer implemented method for providing production optimization of reservoir completions having a plurality of completed intervals via available production analysis and production logging data which provides a quantitative analysis procedure for reservoir and fracture properties using commingled reservoirs, comprising the steps of:

a. measuring pressures for specific zones in a reservoir;

b. selecting a traverse model;

c. computing midzone pressures using the traverse model;

d. comparing the computed midzone pressures with the measured pressures;

e. modeling the bottomhole pressure of the reservoir based on the traverse model;

f. comparing the computed pressures with historic data; and g. determining and selecting a recompletion process for maximizing zone-by-zone production, wherein the reservoir is separated into defined intervals from top to bottom, each having a top point, midpoint and a bottom point and wherein the wellbore pressure traverse is computed using the total reservoir commingled production flow rates to the midpoint of the top completed interval.

13. The method of claim 12, wherein the fluid flow rates of the wellbore between the midpoint of the top and middle completed intervals are computed using the total fluid phase flow rates of the commingled reservoir minus the flow rates from the top completed interval.

14. The method of claim 13, wherein the pressure traverse in the wellbore between the midpoints of the middle and lower completed intervals is computed using the fluid phase flow rates that are the difference between the commingled reservoir system total fluid phase flow rates and the sum of the phase flow rates from the top and middle completed intervals.

15. The method of claim 12, wherein the flow rate and pressure traverse computation in the computation step are performed in a sequential manner for each interval, starting at the wellhead and proceeding to the deepest completed interval.

* * * * *